US005664962A

United States Patent [19]

Noda

[11] Patent Number: 5,664,962

[45] Date of Patent: Sep. 9, 1997

[54] CABLE CONNECTION FOR SIGNAL PROCESSOR OF SEPARATE TYPE SENSORS

[75] Inventor: Sadao Noda, Iwakura, Japan

[73] Assignee: Sunx Kabushiki Kaisha, Tachikawa, Japan

[21] Appl. No.: 258,783

[22] Filed: Jun. 13, 1994

[30] Foreign Application Priority Data

Jun. 14, 1993 [JP] Japan ..... 5-141851

[51] Int. Cl.[6] ..... H01R 4/26

[52] U.S. Cl. ..... 439/394; 439/417

[58] Field of Search ..... 174/65 R, 78; 333/260; 439/409–410, 578–599, 98

[56] References Cited

U.S. PATENT DOCUMENTS

| | | | |
|---|---|---|---|
| 4,157,208 | 6/1979 | Roberts et al. | 439/410 |
| 4,653,829 | 3/1987 | LaMont | 439/409 |
| 4,793,823 | 12/1988 | Cozzens et al. | 439/409 |
| 4,932,894 | 6/1990 | Sherer | 439/409 |
| 4,995,829 | 2/1991 | Grib et al. | 439/409 |
| 5,219,302 | 6/1993 | Robertson et al. | 439/410 |

*Primary Examiner*—Neil Abrams
*Assistant Examiner*—Brian J. Biggi
*Attorney, Agent, or Firm*—Foley & Lardner

[57] ABSTRACT

A signal processor for a sensor includes an enclosure and a cable holder disposed in the enclosure and having a first through hole and a second through hole contiguous to the first through hole. The cable holder is moved when a lever is manipulated. A first terminal is disposed in the enclosure so as to intersect at a right angle to the first through hole and a second terminal is disposed in the enclosure so as to intersect at a right angle to the second through hole. A coaxial cable for connecting between the signal processor and the sensor is inserted into the first and second through holes in turn in the state that an exposed shield wire is folded up along an outer insulating sheath of the cable. When the cable holder is moved upon manipulation of the lever, the first terminal is moved into the first through hole, coming into contact with the exposed shield wire. The second terminal is moved into the second through hole, severing an inner insulating sheath of the cable, coming into contact with a cable core.

2 Claims, 9 Drawing Sheets

CABLE CONNECTION FOR SIGNAL PROCESSOR OF SEPARATE TYPE SENSORS

BACKGROUND OF THE INVENTION

1. Field of the Invention

This invention relates to a signal processor including a circuit receiving a detection signal through a coaxial cable from a sensor unit having a detecting element and performing processing of the detection signal such as by amplifying the same. More particularly, the invention relates to connection of the coaxial cable to such a signal processor.

2. Description of the Prior Art

Sensors such as photoelectric switches or proximity switches are divided into two types, that is, an amplifier built-in type in which a sensor unit provided with a detecting element incorporates an amplifier unit for processing an output signal from the detecting element of the sensor unit and an amplifier separate type in which the amplifier is separated from the sensor unit and one or more coaxial cables are provided for connecting therebetween. Since the sensor and amplifier units are integrated together, the former type sensor can be readily installed in equipment. However, the size of the sensor unit is disadvantageously increased. On the other hand, since only the sensor unit is installed in the equipment in the latter type, the size of the sensor unit can be reduced. The number of the amplifier separate type sensors have recently been increased in use.

The coaxial cable extending from the sensor unit is connected to the amplifier unit in the amplifier separate type sensor. In connection, a shield wire and a cable core of the coaxial cable are exposed out of outer and inner insulating sheaths respectively. The exposed shield wire and cable core are inserted into two terminal holes formed in an insulating sheaths respectively. The exposed shield wire and cable core are inserted into two terminal holes formed in an insulating enclosure of the amplifier unit, respectively. Thereafter, locking members are firmly inserted into the respective terminal holes so that ends of the shield wire and cable core are held in contact with electrical terminals in the terminal holes respectively.

In the above-described manner of connection, the outer and inner insulating sheaths need to be partially stripped off so that the shield wire and the cable core are exposed out of the respective insulating sheaths. The stripping work is troublesome. Furthermore, since the shield wire and the cable core are flexible, it is difficult to insert them into the respective terminal holes. Additionally, the shield wire and the cable core need to be inserted into the separate terminal holes, which further renders the inserting work troublesome. Furthermore another problem is that since two terminal holes for each coaxial cable need to be formed in the insulating enclosure of the amplifier unit, the size of the amplifier unit is increased.

SUMMARY OF THE INVENTION

Therefore, an object of the present invention is to provide a signal processor for a sensor wherein a step for severing the insulating sheaths of the coaxial cable can be simplified, the conductors of the coaxial cable can be readily inserted into the terminal through holes, and the size of the signal processor can be reduced.

The present invention provides a signal processor for a sensor, comprising an enclosure for accommodating therein a signal processing circuit for processing an electrical signal. A coaxial cable is coupled to the enclosure so that the electrical signal is transmitted therethrough. A cable holder is provided in the enclosure and has a first through hole into which the coaxial cable is inserted with an exposed shield wire of the coaxial cable being folded up along an outer insulating sheath of the coaxial cable and a second through hole axially contiguous to the first through hole such that an inner insulating sheath of the coaxial cable is inserted thereto. First and second terminals are disposed in the enclosure to intersect at a right angle to the first and second through holes of the cable holder respectively, the second terminal having a distal end capable of severing the inner insulating sheath of the coaxial cable. A lever is provided in the enclosure to be manually movable. The cable holder is moved toward both terminals when the lever is moved, so that the first and second terminals are moved across the first and second through holes respectively. Consequently, the first terminal comes into contact with the shield wire of the coaxial cable and the second terminal severs the inner insulating sheath of the coaxial cable to thereby come into contact with a cable core of the coaxial cable. The first through hole of the cable holder may include a large diameter portion with a diameter approximately equal to a diameter of the outer insulating sheath of the coaxial cable and a small diameter portion contiguous to the large diameter portion.

The outer insulating sheath of the coaxial cable is stripped off so that the inner insulating sheath is exposed but the cable core remains covered by the inner insulating sheath. The exposed shield wire is them folded up along the outside of the outer insulating sheath. The coaxial cable is inserted into the first and second through holes of the cable holder in turn such that the outer and inner insulating sheaths are located in the first and second through holes respectively. In this state, the cable holder is moved toward the terminals relative to them with movement of the lever. Then, the first terminal comes into contact with the shield wire located along the outer insulting sheath such that the first terminal is electrically connected to the shield wire. Simultaneously, the second terminal severs at its distal end the inner insulating sheath upon the movement of the cable holder, coming into contact with the cable core.

In connecting the coaxial cable to the terminals, the cable core need not be exposed out of the inner insulating sheath. Furthermore, the inner insulating sheath having higher rigidity than the cable core and the shield wire is first inserted into the first and second through holes. Accordingly, the coaxial cable can be readily inserted into the through holes and the inserting work can be easily performed. Additionally, since only one through hole is required for one coaxial cable, the size of the signal processor can be reduced.

BRIEF DESCRIPTION OF THE DRAWINGS

Other objects, features and advantages of the present invention will become clear upon reviewing the following description of preferred embodiments thereof, made with reference to the accompanying drawings, in which.

DESCRIPTION OF THE PREFERRED EMBODIMENTS

A first embodiment of the present invention will be described with reference to FIGS. 1 to 8. The present invention is applied to an amplifier of a reflective type photoelectric sensor in the first embodiment.

Figure 1:
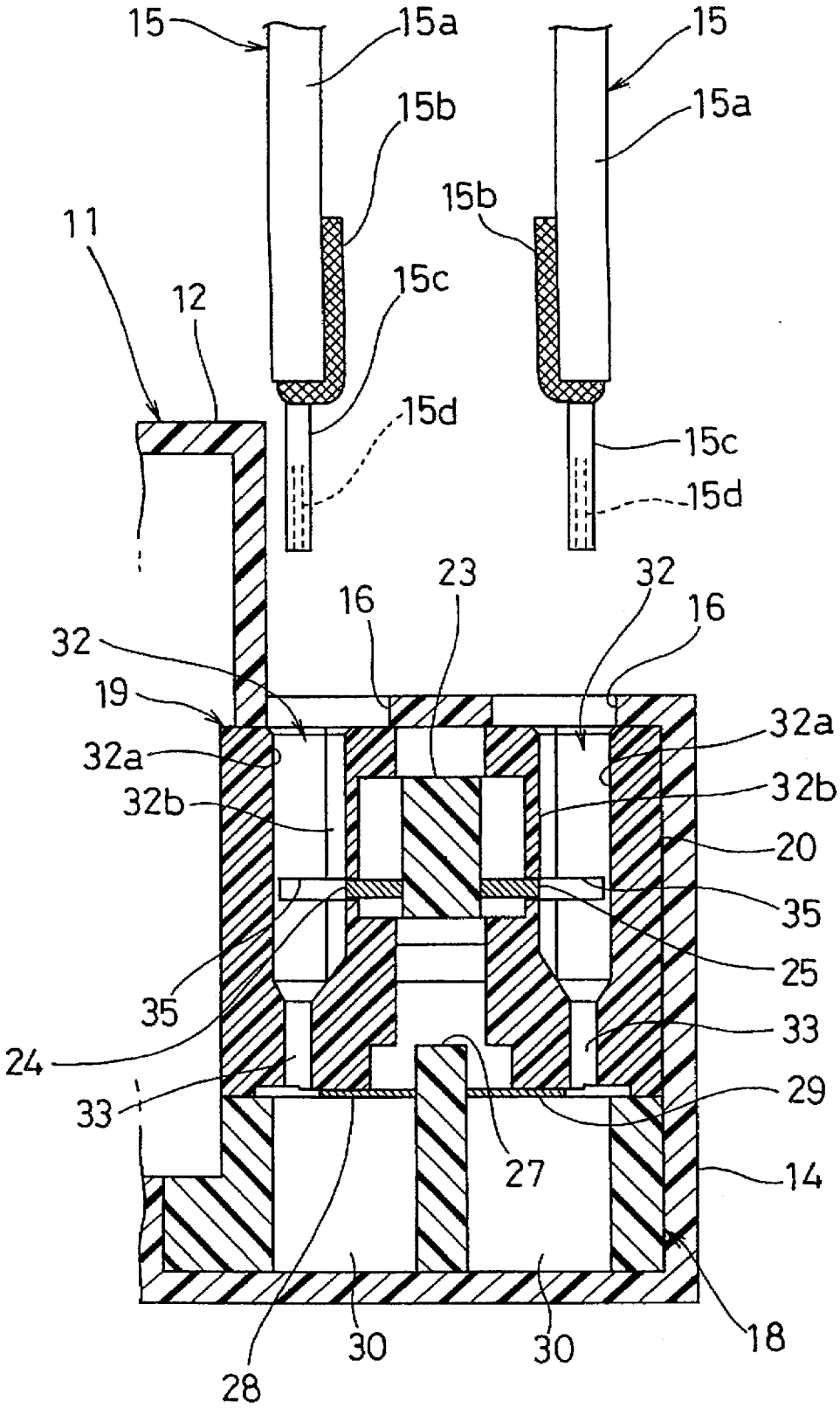
FIG. 1 is a longitudinally sectional side view of a first embodiment of a signal processor in accordance with the present invention.
Figure 2:
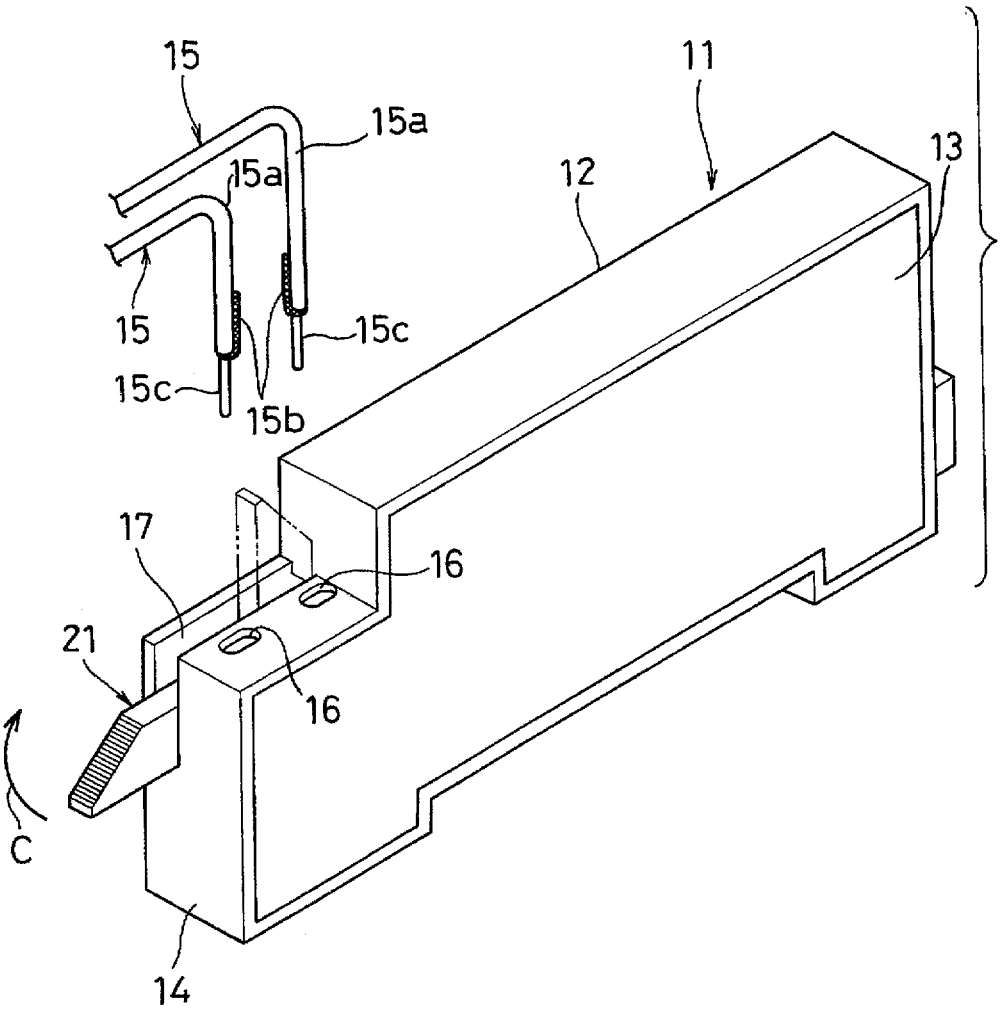
FIG. 2 is a perspective view of the signal processor.
Figure 3:
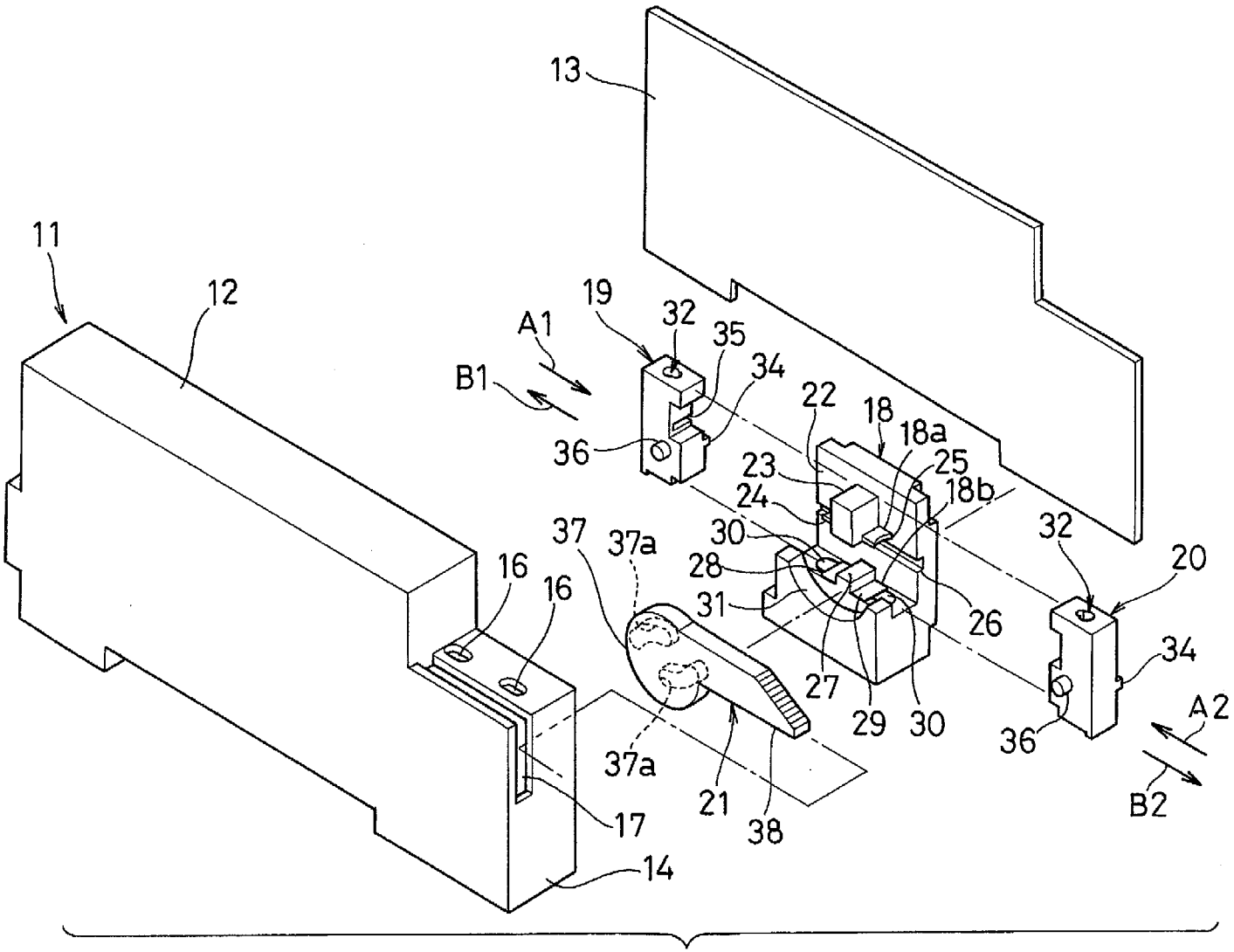
FIG. 3 is an exploded perspective view of the signal processor.

Referring to FIGS. 2 and 3, the amplifier comprises an enclosure 11 including an enclosure body 12 having an open side and a lid 13 closing the open side of the enclosure body 12. The enclosure body 12 is formed from an electrically insulating material. An amplifier circuit (not shown) serving as a detection signal processing circuit is enclosed in the enclosure body 12. The enclosure body 12 includes a connecting section 14 projecting from the right-hand side thereof, as viewed in FIG. 3. The connecting section 14 incorporates a mechanism for connection of two coaxial cables 15 (see FIG. 1) extending from light-emitting and light-receiving elements of a detecting unit respectively.

The above-mentioned cable connecting mechanism will be described. The connecting section 14 of the enclosure body 12 has two through-holes 16 formed in the top and a lever slit 17 extending from the top to the right-hand side thereof. A clamp block 18 and two cable holders 19 and 20 are disposed in the connecting section 14 of the enclosure body 12. Furthermore, a lever 21 is disposed in the connecting section 14 such that a part thereof protrudes out of the slit 17.

Referring to FIG. 3, two first terminals 24 and 25 are inserted through two apertures 18*a* formed in a rising wall 22 of the clamp block 18 respectively. The first terminals 24, 25 are further engaged with a convex portion 23 formed integrally with the clamp block 18 so that the terminals are secured to the clamp block 18. Two second terminals 28 and 29 are also inserted through two apertures 18*b* formed below the convex portion 23 in the clamp block 18 respectively. The second terminals 28, 29 are further engaged with a convex portion 27 so that the terminals are secured to the clamp block 18. A horizontal guide groove 26 is formed in the clamp block 18 below the first terminals 24, 25. Each of the second terminals 28, 29 has such a reduced thickness that a distal end thereof is formed into an edge. Consequently, the second terminals 28, 29 are capable of thrusting into or severing inner insulating sheaths 15*c* of the coaxial cables 15 respectively. Sections of the terminals 24, 25, 28, 29 projecting from a rear wall of the clamp block 18 are connected to the amplifier circuit (not shown). Pockets 30 are provided beneath the second terminals 28, 29 respectively. The clamp block 18 has on its front a semicircular lever holding section 31 for holding the lever 21.

Figure 4:
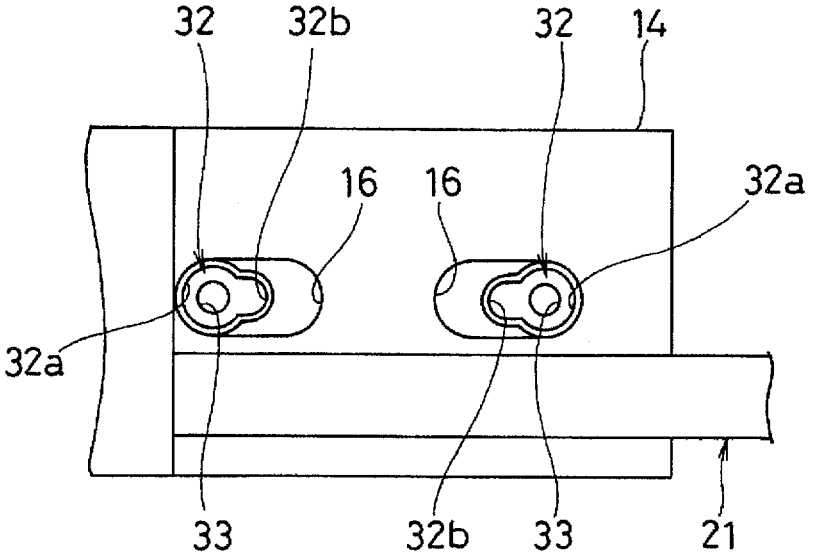
FIG. 4 is a plan view of a connecting case of the signal processor.

Since the cable holders 19, 20 have the same structure, only the cable holder 19 will be described with reference to FIGS. 1 and 3. The cable holder 19 has a first through hole 32 extending vertically and a second through hole 33 formed beneath the first through hole to be axially contiguous with it. The coaxial cable 15 is inserted into the first through hole 32 with an exposed shielding braided wire 15*b* being bundled and folded up along the outer periphery of an outer insulating sheath 15*a* as shown in FIG. 1. The first through hole 32 has a generally keyhole plane configuration as shown in FIG. 4. More specifically, the first through hole 32 includes a large diameter portion 32*a* having a diameter approximately as large as the outer insulating sheath 15*a* of the coaxial cable 15. The first through hole 32 further includes a small diameter portion 32*b* contiguous to the large diameter portion 32*a*. The second through hole 33 is formed to have such a diameter that an inner insulating sheath 15*c* of the coaxial cable 15 can be inserted thereinto. Furthermore, the cable holder 19 has a guide rail 34 formed on the rear wall thereof and a slit 35 formed therein to intersect at a right angle to the first through hole 32. The cable holder 19 further has a shaft 36 formed on the front thereof. The lever 21 includes a generally circular body 37 and a lift knob 38 extending from the body 37. In the rear of the body 37 there are two arc cam grooves 37*a* having a center at the position deviated from the center of the body 37.

The guide rails 34 of the cable holders 19, 20 are slidably fitted into the guide groove 26 of the clamp block 18 so that the cable holders 19, 20 are moved in the directions of arrows A1 and B1 and the directions of arrows A2 and $B_2$, respectively. The first terminals 24, 25 are inserted into the slits 35 of the cable holders 19, 20, when the first terminals 24, 25 intersect at a right angle to the first through holes 32, respectively. The second terminals 28, 29 are located along the bottom surfaces of the cable holders 19, 20 to be parallel with the lower end faces of the second through holes 33, respectively. The body 37 of the lever 21 is rotatably held on the holding section 31 of the clamp block 18. The shafts 36 of the cable holders 19, 20 are engaged with the cam grooves 37*a* respectively. The lift knob 38 of the lever 21 extends horizontally when the lever 21 is placed in its inoperative position. In this state, the distance between the shafts 36 engaged with the respective cam grooves 37*a* of the lever 21 is the longest, as is shown by reference symbol La in FIG. 5.

The operation of the above-described construction will be described. The outer insulating sheath 15*a* of each coaxial cable 15 is stripped so that the shield wire 15*b* is exposed. The exposed shield wire 15*b* is bundled into the shape of a string and folded up along the outer insulating sheath 15*a*. The end of the inner insulating sheath 15*c* is exposed out of the outer insulating sheath 15*a* and the shield wire 15*b*, as shown in FIG. 1.

Figure 6:
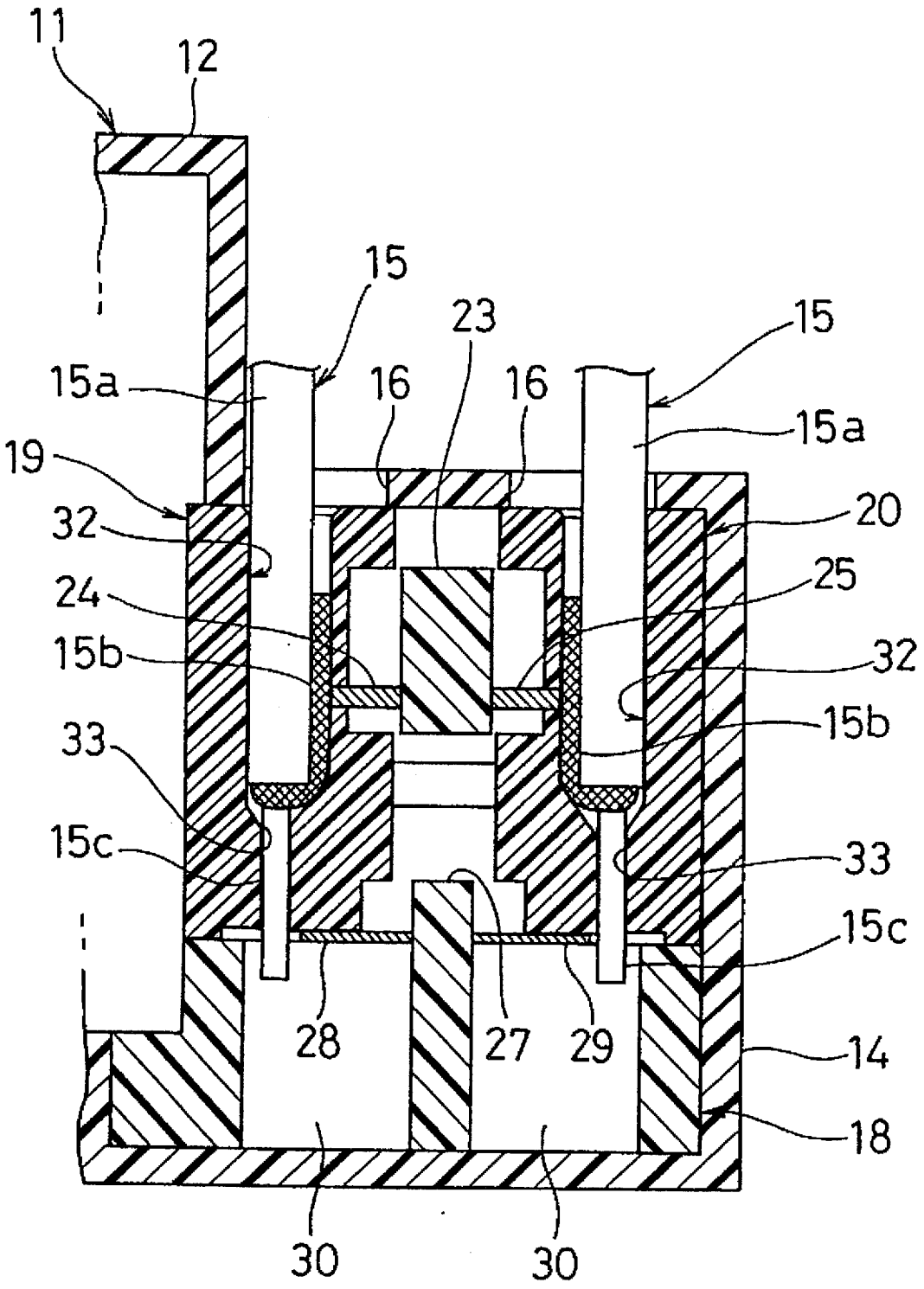
FIG. 6 is a longitudinally sectional side view of the signal processor, the view helping understand connection of coaxial cables to terminals.
Figure 7:
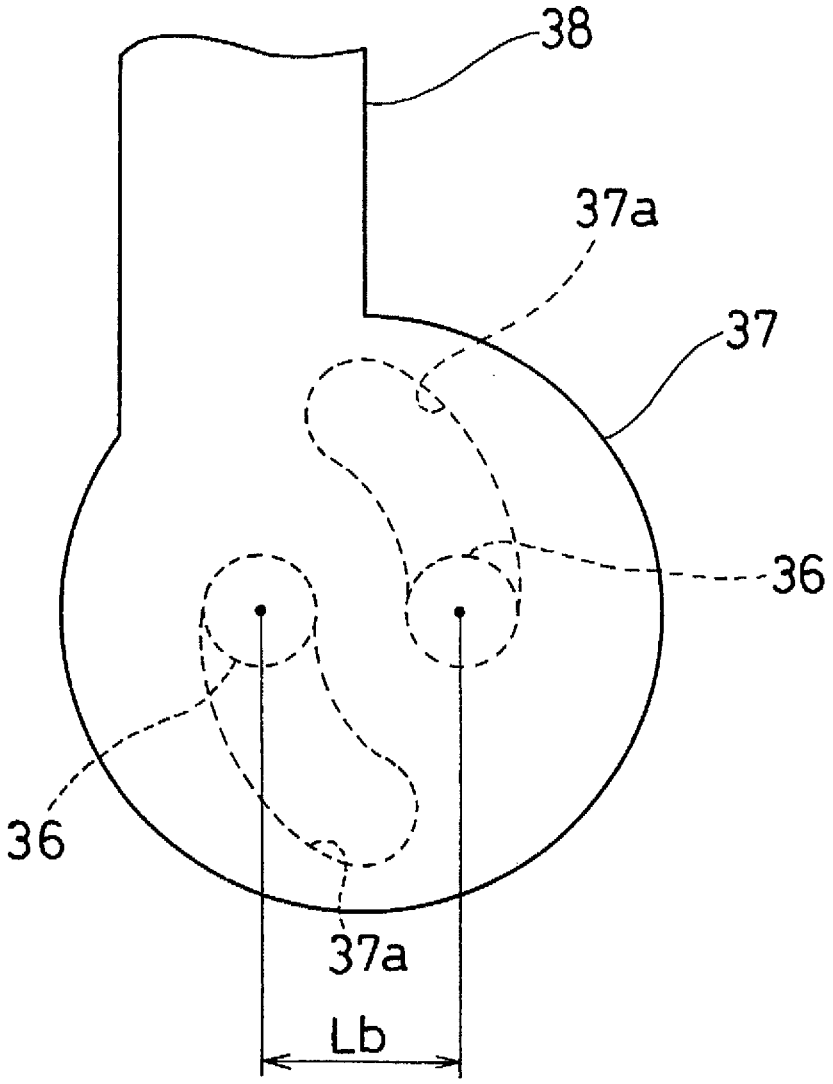
FIG. 7 is a partially side view of the lever in the state different from that in FIG. 5.

The coaxial cables 15 in the above-described state are inserted through the holes 16 into the first through holes 32 and the second through holes 33 in turn so that the bent shielding wires 15b are located in the small diameter portions 32b of the first through holes 32, respectively. Consequently, the distal ends of the inner insulating sheaths 15c project out of the second through holes 33 respectively, as shown in FIG. 6. The outer insulating sheaths 15a of the coaxial cables 15 are located in the large diameter portions 32b of the first through holes 32 respectively. The folded shielding wires 15b are located in the small diameter portions 32b of the first through holes 32 respectively.

Figure 5:
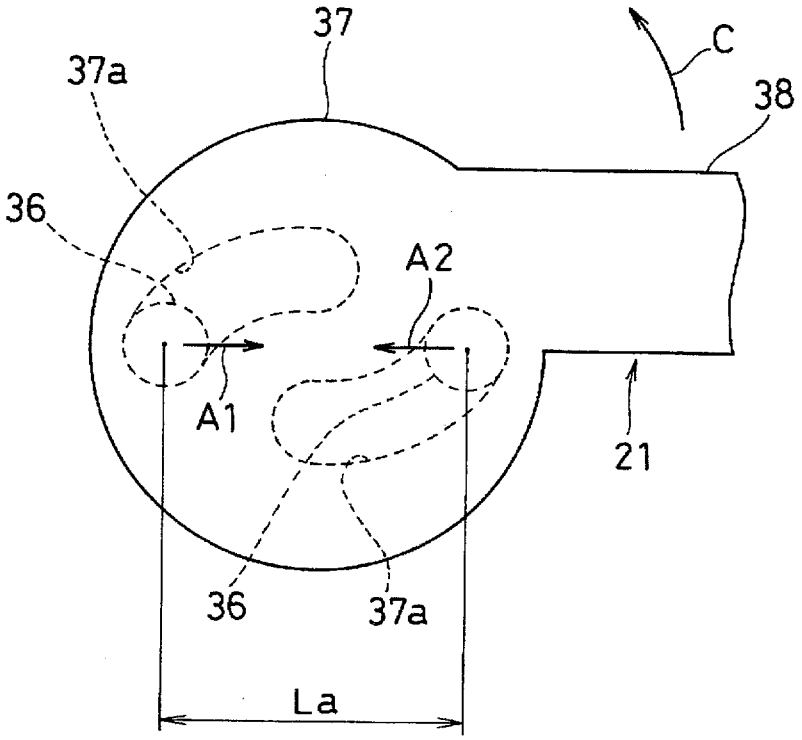
FIG. 5 is a partially side view of a lever of the signal processor.
Figure 8:
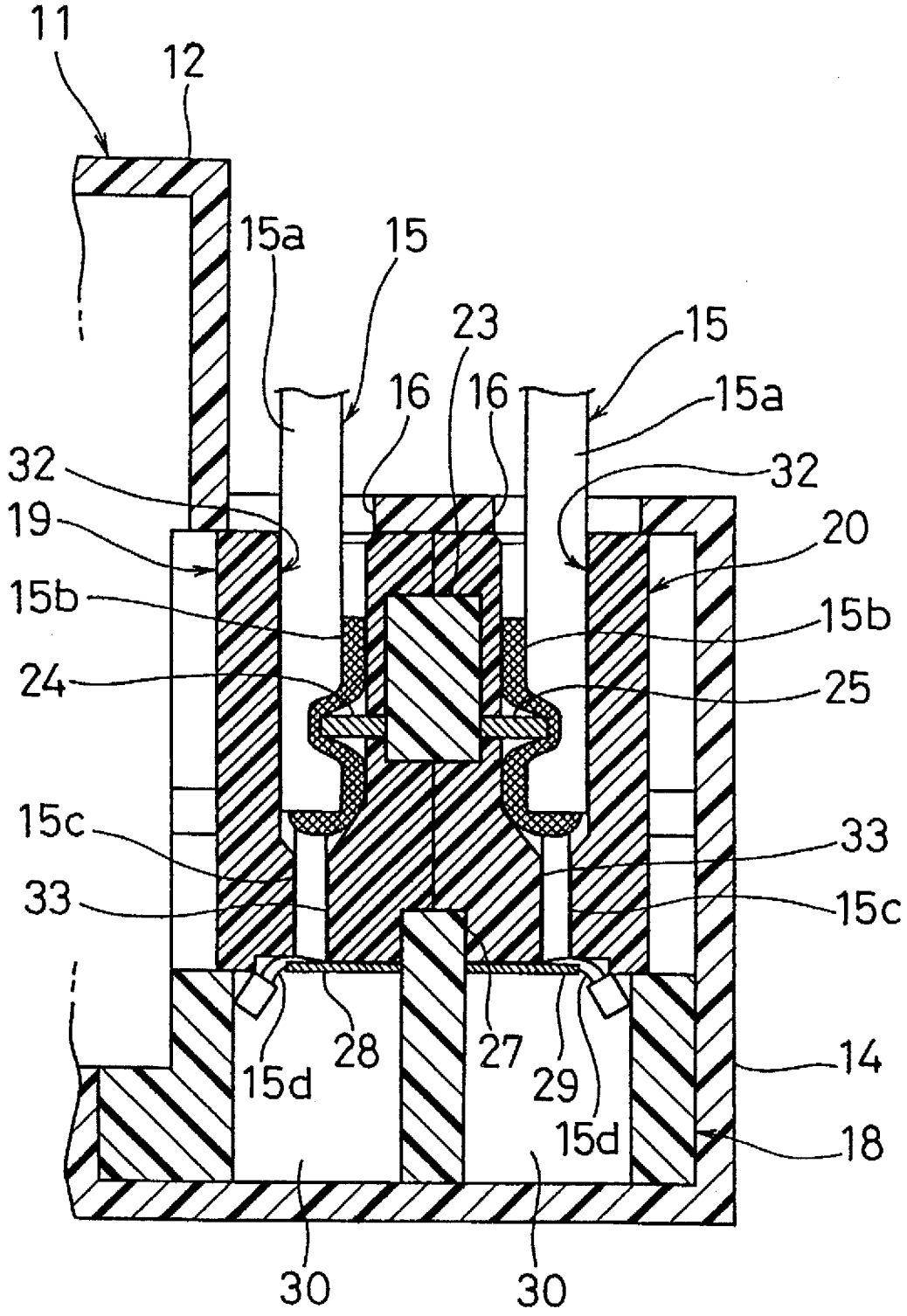
FIG. 8 is a longitudinally sectional side view of the signal processor in the state different from that in FIG. 6.

Subsequently, the lever 21 is rotatively moved from the inoperative position in the direction of arrow C in FIGS. 2 and 5 to the operative position, whereby the shafts 36 of the cable holders 19, 20 are moved along the respective cam grooves 37a such that the cable holders 19, 20 are displaced in the directions of arrows A1, A2 respectively to come close to each other. In this state, the distance between the shafts 36 is shortened as shown by reference symbol Lb in FIG. 7. Consequently, the first terminals 24, 25 are moved through the slits 35 toward the small diameter portions 32b of the first through holes 32 relative to them respectively. Simultaneously, the second terminals 28, 29 are moved across the second through holes 33 relative to them respectively. Consequently, as shown in FIG. 8, the first terminals 24, 25 are pressed against the shielding wires 15b of the coaxial cables 15 to be electrically connected to them, respectively. Simultaneously, the distal ends of the second terminals 28, 29 thrust into the inner insulating sheaths 15c such that the second temriansl 28, 29 are pressed against the cable cores 15d, thereby being electrically connected to them, respectively.

The lever 21 is held at the operative position as the result of engagement of the shafts 36 with the respective cam grooves 37a, so that an electrically conductive state is maintained. The end of inner insulating sheath 15c may be cut off when each of the second terminals 28, 29 has thrust into the inner insulating sheath 15c. However, since the cut sheath remains on the core 15d, the thrust of each second terminal 28, 29 does not usually produce any cut chips. Should any cut chips be produced, they would fall into each pocket 30. In view of such possibility, the bottom of each pocket 30 may be opened so that the cut chips are discharged out of each opening.

According to the above-described embodiment, each cable holder 19, 20 has the first through hole 32 into which the coaxial cable 15 is inserted with its shield wire 15b being folded up along the outer insulating sheath 15a. Each cable holder 19, 20 further has the second through hole 33 axially contiguous to the first through hole 32. The inner insulating sheath 15c of each coaxial cable 15 is inserted into the second through hole 33. Each first terminal 24, 25 is disposed to intersect at a right angle to the first through hole 32. Each second terminal is formed so as to thrust into the inner insulating sheath 15c and is disposed to intersect at a right angle to the second through hole 33. Each coaxial cable 15 with only its shield wire 15b exposed is inserted into the first and second through holes 32, 33 in turn. By rotative movement of the lever 21, each cable holder 19, 20 is moved toward the first terminals 24, 25 and the second terminals 28, 29. Consequently, the shield wire 15b of each coaxial cable 15 can be electrically connected to the first terminal 24, 25 and the cable core 15d can be electrically connected to the second 28, 29.

As obvious from the foregoing, the cable core 15d of coaxial cable 15 need not be exposed. Only the shield wire 15b needs to be exposed. Furthermore, when each coaxial cable 15 is to be inserted into the first and second through holes 32, 33, the inner insulating sheath 15c having relatively high rigidity is first inserted into the first and second through holes. Accordingly, the coaxial cable can be readily inserted into the through holes as compared with the case where an easily flexed cable core or shield wire is first inserted into the through holes. Furthermore, since the coaxial cable is inserted into the contiguous first and second through holes in turn, only one inserting work is required. Consequently, the number of inserting steps can be reduced to half as compared with the case where the cable core and the shield wire of the coaxial cable are inserted into the separate through holes. Additionally, since only one through hole including the contiguous first and second through holes is required for one coaxial cable, the size of the signal processor can be reduced.

In the above-described embodiment, particularly, the first through hole 32 has the large diameter portion 32a with the diameter approximately same as that of the outer insulating sheath 15a of the coaxial cable 15 and the small diameter portion 32b contiguous to the large diameter portion 32a. The shield wire 15b is bundled and folded up along the outer insulating sheath 15a. In this state, the coaxial cable 15 is inserted into the first through hole 32 such that the shield wire 15b is positioned opposite to the first terminal 24, 25. Consequently, the electrical connection between the shield wire 15b and the first terminal can be ensured.

Figure 9:
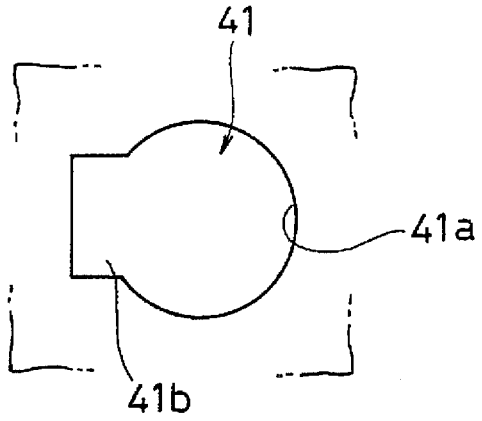
FIG. 9 is a plan view of a first through hole provided in a cable holder provided in a signal processor of a second embodiment in accordance with the present invention, into which through hole a coaxial cable is to be inserted.
Figure 10:
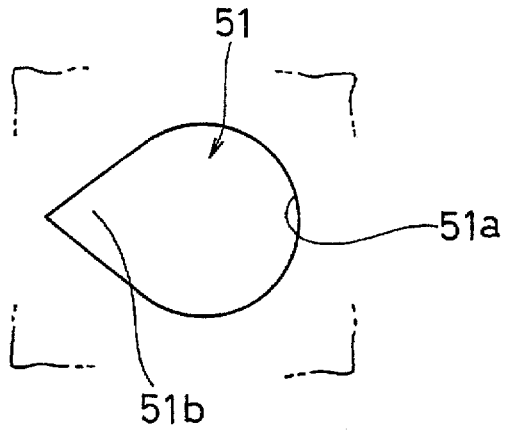
FIG. 10 is a plan view of a first through hole provided in a single processor of a third embodiment in accordance with the present invention, into which through hole a coaxial cable is to be inserted.

The small diameter portion 32b of the first through hole 32 is formed to have the semicircular configuration in the foregoing embodiment. Alternatively, the small diameter portion 32b may be formed to have a configuration as shown as a second embodiment in FIG. 9 or as a third embodiment in FIG. 10. In the second embodiment shown in FIG. 9, the first through hole 41 includes a large diameter portion 41a and a rectangular small diameter portion 41b. In the third embodiment shown in FIG. 10, the first through hole 51 includes a large diameter portion 51a and a generally V-shaped small diameter portion 51b.

Figure 11A:
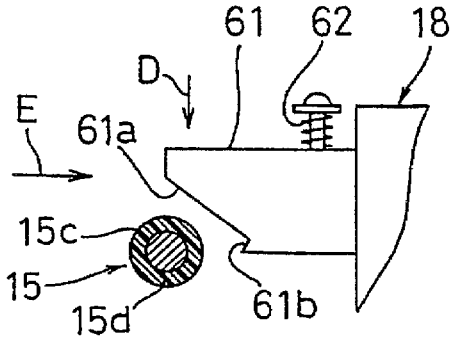
FIGS. 11A and 11B are transversely sectional plan views of a second terminal provided in a signal processor of a fourth embodiment in accordance with the present invention.
Figure 11B:
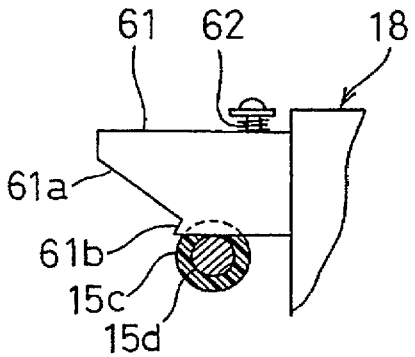

The second terminal may be modified as shown as a fourth embodiment in FIGS. 11A and 11B. The second terminal 61 is formed at its distal end with an inclined face 61a and a thrusting edge 61b. The second terminal 61 is held on the clamp block 18 to be moved in the direction of arrow D and in the direction opposite arrow D. The second terminal 61 is usually urged in the direction of arrow D by a spring 62. When the coaxial cable 15 held on the cable holder (not shown) is moved in the direction of arrow E, the inner insulating sheath 15c collides against the inclined face of the second terminal 61 and is then moved in the direction of arrow E, pushing the second terminal 61 upward. During this movement, the edge 61b of the second terminal 61 thrusts into the inner insulating sheath 15c such that the second terminal 61 comes into contact with the cable core 15d, as shown in FIG. 11B.

Figure 12:
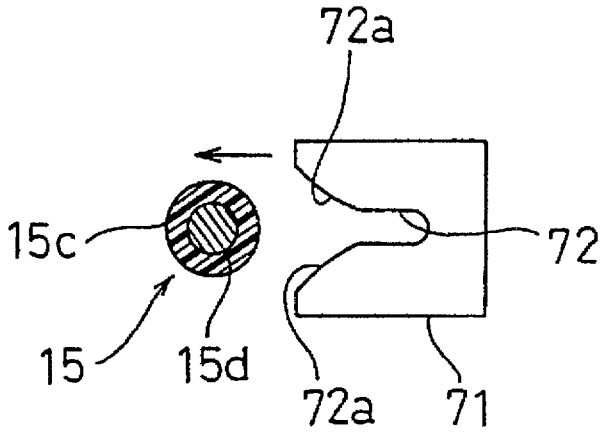
FIG. 12 is a transversely sectional side view of a second terminal provided in a signal processor of a fifth embodiment in accordance with the present invention.

The second terminal may be further formed as shown as a fifth embodiment in FIG. 12. The second terminal 71 has a groove 72 including tapered faces 72a tapered toward the inner end of the groove. The width of the groove 72 is so set as to be slightly smaller than the diameter of the cable core 15d. When the second terminal 71 is moved in the direction of arrow in FIG. 12 relative to the coaxial cable 15, the tapered faces 72a and the edge of the groove 72 thrust into the inner insulating sheath 15c of the coaxial cable 15 such that the second terminal 71 comes into contact with the cable core 15d.

Figure 13:
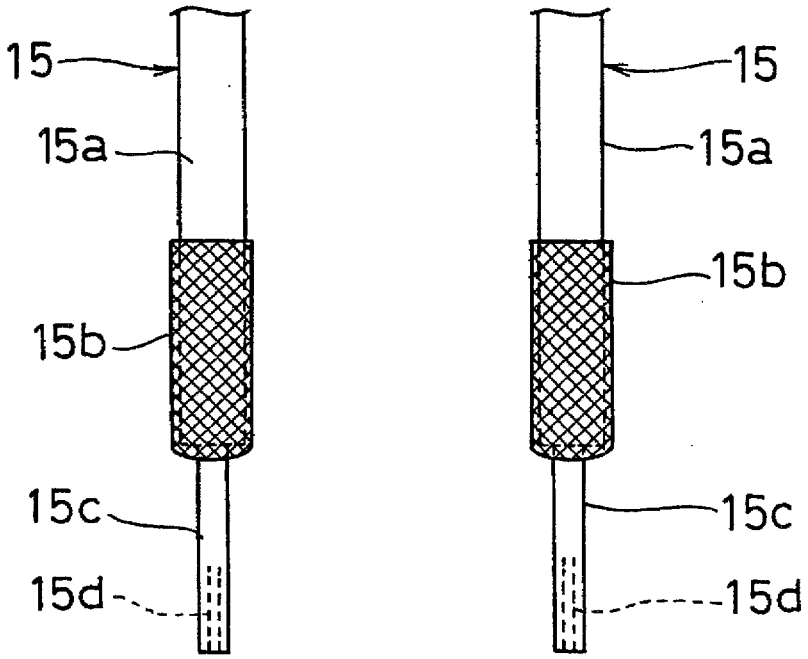
FIG. 13 is a side view of coaxial cables employed in a signal processor of a sixth embodiment in accordance with the present invention.

Although the exposed braided shield wire 15b is bundled in the first embodiment, they may be turned up along the whole outer periphery of the outer insulating sheath 15a, as shown as a sixth embodiment in FIG. 13. The first through hole 32 may be formed to have a circular configuration in the sixth embodiment.

The two coaxial cables are employed for connection between the amplifier and the reflective type photoelectric sensor in the foregoing embodiments. When the present invention is applied to an amplifier of a proximity sensor or the like, only one coaxial cable is employed.

Each cable holder is moved toward the first and second terminals in the foregoing embodiments. Alteratively, the first and second terminals may be moved toward each cable holder.

The foregoing description and drawings are merely illustrative of the principles of the present invention and are not to be construed in a limiting sense. Various changes and modifications will become apparent to those of ordinary skill in the art. All such changes and modifications are seen to fall within the true spirit and scope of the invention as defined by the appended claims.

I claim:

1. A signal processor for a sensor, comprising:

an enclosure for accommodating therein a signal processing circuit for processing an electrical signal;

a coaxial cable, having a shield wire, an outer insulating sheath, and an inner insulating sheath, the coaxial cable being coupled to the enclosure so that the electrical signal is transmitted therethrough;

a cable holder provided in the enclosure and having a first through hole into which the coaxial cable is inserted with the shield wire being folded up along the outer insulating sheath and a second through hole axially contiguous to the first through hole such that the inner insulating sheath is inserted thereinto;

first and second terminals disposed in the enclosure to intersect at a right angle to the first and second through holes of the cable holder respectively, the second terminal having a distal end capable of severing the inner insulating sheath of the coaxial cable; and a lever provided in the enclosure to be manually movable, the cable holder being moved toward both terminals when the lever is moved, so that the first and second terminals are moved across the first and second through holes respectively, whereby the first terminal comes into contact with the shield wire of the coaxial cable and the second terminal severs the inner insulating sheath of the coaxial cable to thereby come into contact with a cable core of the coaxial cable.

2. A signal processor according to claim 1, wherein the first through hole includes a large diameter portion with a diameter approximately equal to a diameter of the outer insulating sheath of the coaxial cable and a small diameter portion contiguous to the large diameter portion.

* * * * *